United States Patent [19]

Mori et al.

[11] 4,390,407

[45] Jun. 28, 1983

[54] ELECTROLYTIC PROCESSING DEVICE FOR BELT-SHAPED METAL PLATES

[75] Inventors: Teruo Mori; Hiroshi Shirai; Tsutomu Kakei; Masaru Watanabe; Tsuneyasu Matsuhisa, all of Shizuoka, Japan

[73] Assignee: Fuji Photo Film Co., Ltd., Kanagawa, Japan

[21] Appl. No.: 295,291

[22] Filed: Aug. 24, 1981

[30] Foreign Application Priority Data

Sep. 10, 1980 [JP] Japan ..... 55-125458

[51] Int. Cl.[3] ..... C25D 5/02; C25D 17/00

[52] U.S. Cl. ..... 204/206; 204/DIG. 7

[58] Field of Search ..... 204/206, DIG. 7

[56] References Cited

U.S. PATENT DOCUMENTS 3,567,595 3/1971 Yates ..... 204/206
3,697,399 10/1972 Usui ..... 204/206
4,183,799 1/1980 Sellitto ..... 204/206

*Primary Examiner*—T. M. Tufariello
*Attorney, Agent, or Firm*—Sughrue, Mion, Zinn, Macpeak & Seas

[57] ABSTRACT

An electrolytic processing device in which either or both surfaces of a belt-shaped metal plate can be selectively subjected to an electrolytic process. In a first electrolytic processing operation wherein only one surface of the belt-shaped metal plate is subjected to processing, an electrical insulating member is disposed between the belt-shaped metal plate and a first group of electrodes arranged over the surface of the belt-shaped metal plate to thereby suppress the flow of current between the belt-shaped metal plate and the first group of electrodes. In a second electrolytic processing operation in which both surfaces of the belt-shaped metal plate are subjected to processing, the electrical insulating member is removed from the position between the electrodes and the belt-shaped metal plate to thereby allow current to flow from the electrodes to both surfaces of the belt-shaped metal plate.

12 Claims, 5 Drawing Figures

ELECTROLYTIC PROCESSING DEVICE FOR BELT-SHAPED METAL PLATES

BACKGROUND OF THE INVENTION

The present invention relates to electrolytic processing device for belt-shaped metal plates. More particularly, the invention relates to an electrolytic processing device capable of electrolytically processing either one or both surfaces of a belt-shaped metal plate selectively.

In electrolytically processing the surface of a metal such as aluminum or iron, an electrolytic plating method, an electrolytic polishing method, an electrolytic etching method, an anodic oxidizing method, an electrolytic coloring method and a satin finish processing method have been extensively employed. Furthermore, a continuous electrolytic processing method is well known in the art in which such an electrolytic processing method is continuously applied to a belt-shaped metal plate.

FIG. 1 is an explanatory sectional view showing the fundamental construction of an electrolytic processing device in which the above-mentioned anodic oxidizing method is applied in a continuous manner to a belt-shaped aluminum plate. As shown in FIG. 1, a belt-shaped aluminum plate 1 is fed into a current feeding bath 2 guided by rolls 4. The bath 2 is filled with an electrically conductive electrolyte 3. The aluminum plate 1 is transported while being immersed in the electrolyte 3. A plurality of anode plates 5 connected to the positive terminal of an electric power source are arranged both sides of the path along which the aluminum plate 1 passes. Thus, the aluminum plate 1 acts as the cathode in the electrolyte in the bath 2.

The aluminum plate 1 is moved from the bath 2 into an electrolytic bath 6. The current feeding bath 2 is separated from the electrolytic bath 6 by a partition 7. The electrolytic bath 6 is filled with an electrolyte 8. A plurality of cathode plates 9 and 9' connected the negative terminal of the electric power source are arranged both sides of the path along which the aluminum plate 1 passes. Thus, the aluminum plate 1 acts as the anode in the electrolytic bath 6. As a result of electrolysis of the electrolyte 8, the surface of the aluminum plate 1 is oxidized and an oxide film is formed thereon. The aluminum plate 1 on the surface of which the oxide film has been formed as described above is delivered to the next processing stage where it is subjected to an after treatment as required.

Devices for electrolytically processing aluminum plates as described above have been disclosed in U.S. Pat. Nos. 3,038,850 and 3,471,375, Japanese Patent Publication Nos. 16530/1967 and 7842/1970 and Japanese Patent Application (OPI) (the term "OPI" as used herein refers to a "published unexamined Japanese Patent Application") No. 106927/1974. These devices are excellent for electrolytically processing both surfaces of a belt-shaped aluminum plate. However, they are nevertheless economically disadvantageous if it is desired to subject only one surface of the aluminum plate to electrolysis in that a film is unavoidably formed on both surfaces.

A device for subjecting only one surface of an aluminum plate to electrolysis has been disclosed in Japanese Patent Publication No. 8711/1961 and Japanese Patent Application (OPI) No. 29001/1972. In contrast with the above-described devices, these devices are inconvenient in the case where it is desired to electrically process both surfaces of an aluminum plate.

Devices which can process one or both surfaces of a metal plate have been proposed in Japanese Patent Publication Nos. 15287/1967 and 23127/1971. The device described in the former employs a system in which no electrode is provided on the side of a metal plate surface which should not be subjected to electrolytic process. Therefore, if it is desired to switch from a two-surface process to a single surface process, it is necessary to remove the electrodes provided on the side of the metal plate surface which should not be processed. Thus, this device is not very practical. On the other hand, the device described in the latter Publication employs a method in which no electrolyte is supplied to the side of a metal plate surface which should not be processed. However, that device has not found much practical use because the distance between the surface of a liquid film formed on the metal plate surface and the electrodes is variable so that the resultant film is not uniform.

Accordingly, a first object of the present invention is to provide an electrolytic processing device which can selectively electrolytically process either both surfaces or one surface of a belt-shaped metal plate.

A second object of the invention is to provide electrolytic processing device in which an electrolytic process for both surfaces of a belt-shaped metal plate and an electrolytic process for one surface of a belt-shaped metal plate can be readily and selectively employed.

SUMMARY OF THE INVENTION

In order to achieve the objects, the inventors have conducted intensive research and accomplished the invention. The invention provides an electrolytic processing device in which electrodes are arranged on both sides of a belt-shaped metal plate run continuously in an electrolytic solution. In a first electrolytic processing operation of electrolytically processing only one surface of the metal plate, an electric insulating member is disposed between the metal plate and a first group of electrodes arranged over the other surface of the metal plate to suppress the flow of current between the metal plate and the first group of electrodes. In a second electrolytic processing operation of electrolytically processing both surfaces of the metal plate, the insulating member is removed from the position where the insulating member is disposed in the first electrolytic processing operation, wherein current is allowed to flow between the metal plates and all of the electrodes arranged on both sides of the metal plate so that the first and second electrolytic operations are operable repeatedly.

BRIEF DESCRIPTION OF THE DRAWINGS

In FIGS. 2A through 5B, the "A" drawing illustrates the case where one surface of the aluminum plate is subjected to electrolytic processing while the "B" drawing shows the case where both surfaces of the aluminum plate are subjected to electrolytic processing.

DESCRIPTION OF THE PREFERRED EMBODIMENTS

An anodic oxidizing device, as an example of an electrolytic processing device according to the invention, will be described with reference to the accompanying drawings.

FIGS. 2A through 4B are sectional views taken in the longitudinal direction (the direction of movement) of a belt-shaped aluminum plate showing various examples of an electrolytic bath in an anodic oxidizing device of the invention. FIGS. 5A and 5B are cross-sectional views taken in the longitudinal direction of run of a belt-shaped aluminum plate showing another example of an electrolytic bath of the electrolytic processing device of the invention. In each of FIGS. 2A through 5B, the "A" figures show the case of electrolytically processing one surface of the aluminum plate while the "B" figures show the case of electrolytically processing both surfaces.

Figure 2A:
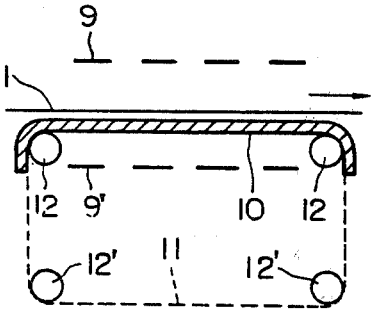
FIGS. 2A through 4B are sectional views, taken along the direction of running of a belt-shaped aluminum plate, showing essential components of various examples of an electrolytic bath in a belt-shaped alumunum plate anodic-oxidizing device according to the invention.

As shown in FIG. 2A, cathode plates 9 and 9' are arranged on both sides of a belt-shaped aluminum plate which is run in the direction of the arrow. A flexible, electrical insulating sheet 10 is disposed between aluminum plate 1 and the cathode plates 9' provided below the aluminum plate 1 so that the flow of electric current between the aluminum plate 1 and the cathode plates 9' is suppressed. On the other hand, no electric insulating sheet is disposed between the aluminum plate 1 and the cathode plates 9 provided above the aluminum plate 1. Therefore, if the electrolytic process is carried out in this state, then only one surface of the belt-shaped aluminum plate 1 is subjected to anodic oxidation selectively. The insulating sheet 10 in combination with a wire 11 forms a closed loop around the four rolls 12 and 12'. If the loop is rotated so that the insulating sheet 10 is positioned beneath the lower rolls 12', current will flow between the lower suraface of the belt-shaped aluminum plate 1 and the cathode plates 9' as in the above-described case in which current flows between the upper surface and the cathode plates 9. Thus, in this case, anodic oxide films are formed on both surfaces of belt-shaped aluminum plate 1.

Figure 2B:
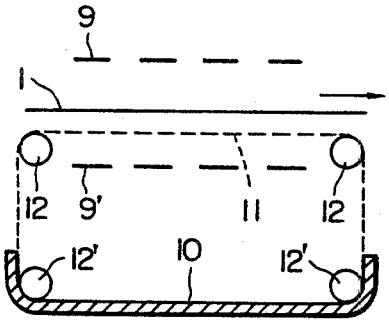

In the method illustrated in FIGS. 2A and 2B, the insulating sheet 10 and the wire 11 form a closed loop around the four rolls 12 and 12'. This method may be modified by employing the rolls 12 and 12' as the winding cores of a winding machine so that for electrolytically processing only one surface of a metal plate, the insulating sheet is laid over the rolls 12 while for electrolytically processing both surfaces, the insulating sheet is wound on one of the rolls 12'.

As described above, as the insulating sheet 10 can be moved from a position between the belt-shaped aluminum plate 1 and the cathode plates 9' to a position where the flow of current between the aluminum plate 1 and the cathode plates 9' is not suppressed and vice versa, both of the single-surface process and the both-surface process can be readily carried out.

Figure 3A:
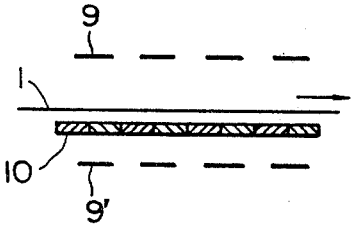
Figure 3B:
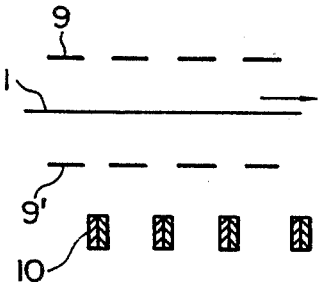

In the example shown in FIG. 3A, a plurality of rectangular, electric insulating plates 10 in close contact with one another are disposed between the belt-shaped aluminum plate 1 and the cathode plates 9' so that the flow of current between the aluminum plate 1 and the cathode plates 9' is suppressed. In this case, only one surface of the aluminum plate 1 is subjected to anodic oxidation. On the other hand, if the electrolytic process is carried out after the electrical insulating plates 10 separated from one another (for instance, into pairs) are moved to positions below the cathode plates 9' as shown in FIG. 3B, then anodic oxide films will be formed on both surfaces of the aluminum plate 1. The movement of the insulating plates 10 can be achieved, for example, by the provision of guides rails (not shown).

Figure 4A:
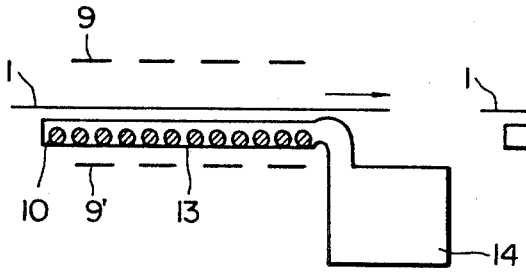
Figure 4B:
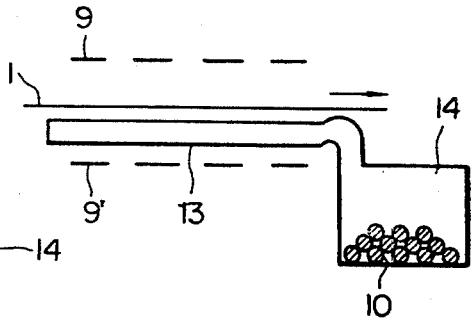
Figure 5A:
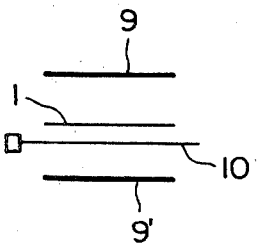
FIGS. 5A and 5B are sectional views, taken along a direction perpendicular to the direction of running of a belt-shaped aluminum plate, showing essential components of another example of the electrolytic bath in the electrolytic processing device according to the invention.
Figure 5B:
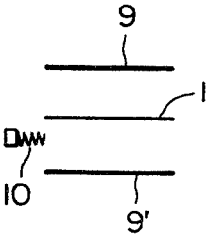

In the example shown in FIG. 4A, a plurality of round bars 10 made of electrically insulating material are supported by guide rails 13 arranged on both sides of the bars 10 with the round bars 10 in close contact with one another so as to suppress the flow of current between the belt-shaped aluminum plate 1 and the cathode plates 9'. If, under this condition, the electrolytic process is carried out, only one surface of the aluminum plate 1 will be subjected to anodic oxidation. On the other hand, in order to form anodic oxide films on both surfaces of the aluminum plate 1, the electrolytic process is carried out after the round bars 10 disposed between the aluminum plate 1 and the cathode plates 9' are moved into a container 14 which is formed at one end of the guide rails 13 as shown in FIG. 4B.

FIGS. 5A and 5B show an anodic oxidizing device which employs as an electrical insulating member a sheet member 10 which is foldable in zigzag form. For anodic oxidation of one surface of the amuminum plate 1, the insulating sheet member 10 is extended at shown in FIG. 5A to suppress the flow of current between the aluminum plate 1 and the cathode plates 9'. For anodic oxidation of both surfaces of the aluminum plate 1, the sheetmember 10 is folded in a direction perpendicular to the direction of running of the aluminum plate 1 as shown in FIG. 5B.

While several examples of the electrolytic processing device according to the invention have been described, it is evident that the device can be modified and implemented in other manners.

As is apparent from the above description, the electrical insulating member used in the invention may be in the form of a plate, a sheet, a round bar, or an angled bar, depending on the intended use. The electrical insulating member disposed between the belt-shaped aluminum plate and the cathode plates may be in the form of one unit, or may be a member which can be separated into a desired number of pieces. However, an insulating member structured in the form of one unit is preferable because it is more effective in suppressing the current.

It is preferable that the width of the insulating member be larger than the width of a belt-shaped aluminum plate. More specifically, it should be larger by at least 20 cm, preferably at least 40 cm, than the width of the aluminum plate. The maximum width of the insulating member is not particularly limited except by the width of the electrolytic bath. Furthermore, it is desirable that, in the electrolytic process for one surface only of a belt-shaped aluminum plate, that the length of the electrical insulating member with respect to the direction of running of the aluminum plate or the range of installation of the insulating member be equal to or larger than the range of installation of the cathode plates.

In the elelctrolytic process for one surface only of a belt-shaped aluminum plate, the distance between the aluminum plate and the electrical insulating member suitably is 0 to 50 mm, preferably 1 to 40 mm, and most preferably 3 to 30 mm. With the electrical insulating member positioned as described above, on the surface of the aluminum plate which confronts the insulating member, an anodic film of the order of 5 to 30% by weight of the anodic film which is formed on the other surface may be formed. However, an anodic film of this order is convenient for handling because it increases the mechanical strength of the rear surface of the aluminum plate thus preventing the occurrence of scratches, etc.

The electric insulating member used in the invention may be made of any electrical insulating material such as plastic, rubber or ceramic although it is preferably made of plastic because the latter is most suitable for machining.

In accordance with the invention, sulfuric acid, oxialic acid, phosphoric acid or chromic acid is employable as the electrolytic in the electrolytic bath with sulfuric acid being the most preferable.

In the invention, the above-described electrolyte for the electrolytic bath can be used as the current feeding electrolyte. For anodic oxidization, the same electrolyte may be used for the current feeding bath and the electrolytic bath or different electrolytes may be used for desired.

Conditions for forming anodic oxide films in the invention, being dependent on the type of electrolyte used, cannot be simply determined. However, usually it is suitable that the concentration of electrolyte be about 1 to 80 percent by weight with the temperature of the electrolyte being about 5 to 70° C., the voltage about 1 to 100 volts, and the electrolysis time about 5 sec. to 5 min. More specifically, it is preferable that these conditions be set as indicated in the following Table 1:

TABLE 1

| Electrolyte | Concentration (wt %) | Temperature (°C.) | Current Density (A/dm) | Voltage (volt) | Electrolysis time (sec) |
|---|---|---|---|---|---|
| Sulfuric Acid | 1~70 | 5~65 | 0.5~30 | 1~50 | 7~120 |
| Oxialic Acid | 1~20 | 20~60 | 0.5~20 | 10~70 | 7~240 |
| Phosphoric Acid | 2~60 | 20~60 | 0.5~20 | 10~60 | 7~240 |
| Chromic Acid | 2~30 | 30~60 | 0.5~10 | 10~60 | 7~240 |

In Table 1, in the case where sulfuric acid is employed as the electrolyte, it is more preferable to set the concentration to about 10 to 30 wt% and the temperature to about 20° to 50° C.

In accordance with the invention, with respect to the waveform of current used for electrolytic processing, a direct current, and intermittent current, a pulse current, a PR current, and superposed a.c. and d.c. currents, as described in "Metal Surface Techniques", Vol. 24, pp 34 to 42 (1973) and the "The 48th Science Lecture Meeting, Abstract" pp 14 to 15, both published by the Metal Surface Techniques Association. However, of these, direct current is most preferable.

The case where one surface or both surfaces of a belt-shaped aluminum plate is subjected to anodic oxidation has been described. Anodic oxidation of the rear surface of the aluminum plate is suppressed using the principle that the quantity of current flowing between the rear surface of the aluminum plate and the cathode plates is reduced by the insulating plate disposed therebetween. Therefore, the invention is applicable to the case where the electrolytic process is applied to a belt-shaped metal plate by utilizing the same electro-chemical action such as in a case where, for instance, one surface or both surfaces of a belt-shaped metal plate are subjected to electrolytic plating, electrolytic polishing, electrolytic etching, electrolytic coloring or electrolytic satin finish.

In order to clarify the effects of the invention, a specific example thereof will be described.

EXAMPLE 1

A belt-shaped aluminum plate having a thickness of 0.24 mm and a width of 1,030 mm (formed in accordance with Japanese Industrial Standard A1100) was fed by a plate feeding machine. After being grained with a brush, the aluminum plate was washed with tap water flowing at a rate of 50 l/min for fifteen seconds. The aluminum plate thus treated was etched with an aqeuous solution of sodium hydroxide of 10wt% at 55° C. for twenty seconds and was then washed according to the above-described method. Thereafter, the aluminum plate was desmutted with a nitric acid solution of 30 wt% at 20° C. for twenty seconds and then washed according to the above-described method.

Figure 1:
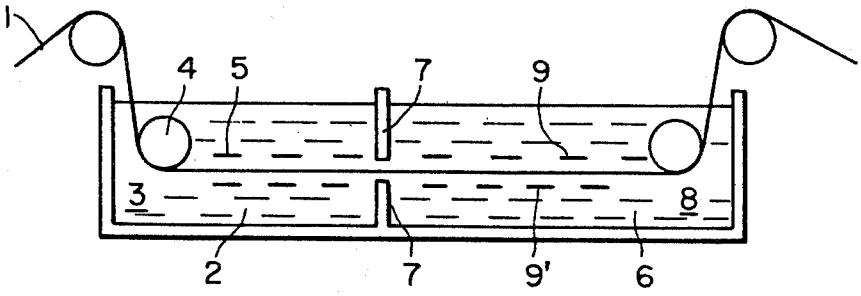
FIG. 1 is a sectional view showing a fundamental arrangement of an anodic oxidizing device for a belt-shaped aluminum plate.

The aluminum plate thus treated was subjected to anodic oxidation. The anodic oxidation was carried out with the device as shown in FIG. 1 using the electrolytic bath as shown in FIG. 2. The aluminum plate was processed with an electrolytic solution, specifically, a sulfuric acid solution of 15 wt%, at a temperature of 30° C. for twenty seconds. Ten cathode plates made of stainless steel were arranged on only one side of the aluminum plate and connected to the power source at first ends thereof.

The insulating plate used was a polyvinyl chloride sheet with a thickness of 2.0 mm thick. The vinyl chloride sheet, which has a width of 1800 mm, was spaced 3.0 mm from the aluminum plate. The current density was set to 12 A/dm$^2$ when the insulating plate was used and was set to 16 A/dm$^2$ when the insulating plate was not used. The results are indicated in Table 2 below:

TABLE 2

| | Current density (A/dm$^2$) | Oxide film (g/m$^2$) Electrode side | Oxide film (g/m$^2$) Insulator side | Power ratio |
|---|---|---|---|---|
| One surface | 12 | 2.7 | 0.4 | 73 |
| Both surfaces | 16 | 2.7 | 1.5 | 100 |

What is claimed is:

1. An electrolytic processing device comprising:

means for receiving an electrolytic solution;

means for transporting a belt-shaped metal plate through electrolytic solution in said receiving means;

first and second groups of electrodes, said first group of electrodes being positioned above a running path of said belt-shaped metal plate and said second set of electrodes being positioned below said running path of said belt-shaped metal plate; and an electrical insulating member removably disposed between one of said groups of electrodes and said running path of said belt-shaped metal plate, wherein when said electrical insulating member is spaced between said one of said groups of electrodes and said running path of said belt-shaped metal plate, electric current flows to only one side of said metal plate, and when said electrical insulating member is removed, electrical current flows to both sides of said metal plate.

2. The electrolytic processing device of claim 1 wherein said electrical insulating member comprises an insulating sheet coupled to a support member in a closed loop and a plurality of rolls, said support member being longer than said insulating sheet, said insulating sheet and said support member being laid around said rolls wherein said insulating sheet can be rotated to a first position between said one of said groups of electrodes and said running path of said belt-shaped metal plate and a second position outside of said position between said one of said groups of said electrodes and said belt-shaped metal plate.

3. The electrolytic processing device of claim 1 wherein said electrical insulating member comprises a plurality of rectangular insulating plates disposable in contact with one another in a position between said one of said groups of said electrodes and said running path of said belt-shaped metal plate, said rectangular insulating plates being movable to a position outside of said first and second groups of electrodes.

4. The electrolytic processing device of claim 1 wherein said electrical insulating member comprises a plurality of round bars of insulating material, guide rails for supporting said round bars in contact with one another at a position between said one of said groups and said running path of said belt-shaped metal plate; and a container for receiving said round bars at a position outside of said first and second groups of electrodes.

5. The electrolytic processing device of claim 1 wherein said electrical insulating member comprises a sheet member foldable in zig zag form, said sheet member being extendable to said position between said one of said electrodes and said running path of said belt-shaped metal plate and foldable to a position outside of said first and second groups of electrodes.

6. The electrolytic processing device of any of claims 1–5 wherein the width of said electrical insulating member is at least 20 cm larger than the width of said belt-shaped metal plate.

7. The electrolytic processing device of any of claims 1–5 wherein the width of said electrical insulating member is at least 40 cm larger than the width of said belt-shaped metal plate.

8. The electrolytic processing device of any of claims 1–5 wherein a distance between said belt-shaped metal plate and said electrical insulating member is in a range of 0 to 50 mm.

9. The electrolytic processing device of any of claims 1–5 wherein a distance between said belt-shaped metal plate and said electrical insulating member is in a range of 1 to 40 mm.

10. The electrolytic processing device of any of claims 1–5 wherein a distance between said belt-shaped metal plate and said electrical insulating member is in a range of 3 to 30 mm.

11. The electrolytic processing device of any of claims 1–5 wherein said electrolytic solution contains an electrolyte selected from the group consisting of sulfuric acid, oxialic acid, phosphoric acid and chromic acid.

12. The electrolytic processing device of any of claims 1–5 wherein said electrolytic solution contains an electrolyte selected form the group consisting of sulfuric acid, oxialic acid, phosphoric acid and chromic acid, and wherein an electrolytic solution density, an electrolytic solution temperature, a current density applied to said belt-shaped metal plate, a voltage imposed between said first and second groups of electrodes and said belt-shaped metal plate and an electrolysis time are set within ranges defined by:

| Electrolyte | Concentration (wt %) | Temperature (°C.) | Current Density (A/dm) | Voltage (volt) | Electrolysis time (sec) |
|---|---|---|---|---|---|
| Sulfuric Acid | 1~70 | 5~65 | 0.5~30 | 1~50 | 7~120 |
| Oxialic Acid | 1~20 | 20~60 | 0.5~20 | 10~70 | 7~240 |
| Phosphoric Acid | 2~60 | 20~60 | 0.5~20 | 10~60 | 7~240 |
| Chromic Acid | 2~30 | 30~60 | 0.5~10 | 10~60 | 7~240 |

* * * * *